United States Patent [19]

Chandler

[11] 4,001,999

[45] Jan. 11, 1977

[54] WOOD TRUSS STRUCTURE WITH ECCENTRIC END SUPPORT

[76] Inventor: Benson Chandler, P.O. Box 224, Medina, Wash. 98039

[22] Filed: Oct. 10, 1975

[21] Appl. No.: 621,341

Related U.S. Application Data

[60] Continuation-in-part of Ser. No. 319,320, Dec. 29, 1972, abandoned, which is a division of Ser. No. 68,715, Sept. 1, 1970, Pat. No. 3,709,762.

[52] U.S. Cl. ..... 52/693; 52/642; 52/691

[51] Int. Cl.[2] ..... E04C 3/17; E04C 3/42

[58] Field of Search ..... 52/639, 641, 642, 645, 52/646, 690, 693, 691

[56] References Cited

UNITED STATES PATENTS

| | | | |
|---|---|---|---|
| 1,878,281 | 9/1932 | Lucy | 52/693 |
| 1,983,874 | 12/1934 | Pratt | 52/642 |
| 3,067,544 | 12/1962 | Willatts | 52/691 |
| 3,345,792 | 10/1967 | Chandler | 52/642 |
| 3,490,188 | 1/1970 | Troutner | 52/690 |
| 3,748,809 | 7/1973 | Jackson | 52/693 |

*Primary Examiner*—Alfred C. Perham
*Attorney, Agent, or Firm*—Strauch, Nolan, Neale, Nies & Kurz

[57] ABSTRACT

A wood truss or joist structure, including a top chord member and diagonal members joining the top chord member adjacent the ends of the latter, the top chord member having support surfaces inwardly offset from the intersection of the center lines of the top chord and diagonal members to distribute bending moments throughout the truss. All members are adhesively secured together.

4 Claims, 7 Drawing Figures

WOOD TRUSS STRUCTURE WITH ECCENTRIC END SUPPORT

CROSS REFERENCE TO RELATED APPLICATIONS

This is a continuation-in-part of Ser. No. 319,320, filed Dec. 29, 1972 now abandoned, which in turn is a division of Ser. No. 68,715, filed Sept. 1, 1970, now U.S. Pat. No. 3,709,762, issued Jan. 9, 1973.

BACKGROUND OF THE INVENTION

As set forth in the patents of others, such as U.S. Pat. Nos. 2,520,333; 3,067,544; and 3,170,198, and in the applicant's U.S. No. 3,345,792, wood built construction of principal structural components of buildings have been indicated wherein no or little reliance was placed on metallic fasteners. However, there remained requirements for stronger all wood principal structural components, secured together with glue without reliance upon metallic fasteners, which could be fabricated and sold in competition with combined wood and metal, and all metal principal structural components such as joints, trusses, etc.

Therefore an integrated analysis, was undertaken of: embodiments of all wood structural products; available adhesives, fillers and combinations and mixtures thereof; embodiments of apparatus and of related factory layouts. The initial analysis indicated past and current designs, development, and inventions were not meeting the competition of combined wood and metal, and all metal principal structural components, because the resultant overall strengths were not to be realized while still providing a competitive product. As a consequence, new embodiments of products, new manufacturing apparatus, and new methods of fabrication were all relatedly invented together to offer, competitively these all wood principal structural components.

A principal feature of the instant invention is an eccentric arrangement of diagonal, top chord and reaction thrusts rather than a concentric intersection of such thrusts, such as shown in my prior U.S. Pat. No. 3,345,792.

SUMMARY OF THE INVENTION

All wood fabricated principal structural components for erection in overall structures are offered in competition with combined wood and metal and all metal structural components. They are secured together without any inclusion of metallic fasteners. Sole reliance is placed upon strengths of controlled glue lines and surfaces. Whole wood components are arranged to form a selected fabricated structural member, such as a joist or truss, and then they are positioned and held by gluing grain oriented, overlying, plywood components at their joining locations. Throughout all whole wood and plywood components, their best strengths, based on their respective directional orientation of their wood grains, are relied upon to obtain the maximum overall resultant strength of any selected embodiment of these all wood fabricated principal structural components.

Of particular importance is the predetermined orienting of components so that in the end joints, eccentricity is preplanned or controlled to thereby minimize excessive bending stresses in all the main members. Plywood reinforcements are so oriented that the wood grains of their plies or laminations are positioned on a bias, which greatly enhances their tearing and peeling resistance. Additionally, a majority of their plies are positioned parallel to the compression forces to reinforce the compression members at the point of maximum bending stress.

The methods of fabrication and apparatus utilized in producing them center on transverse movements throughout assembly, pressing and finishing stations, wherein minimum overall handling is necessary and only minimal fabrication areas are needed. The production results are all wood fabricated structural components, such as joists and trusses, which are stronger than any heretofore known all wood components ever produced, with the purpose in mind of being able to competitively price them in competition with other types of structural components comprising either all metal members or combined metal and wood members.

BRIEF DESCRIPTION OF THE DRAWINGS

Selected embodiments of an all wood fabricated principal structure component are illustrated in the drawings, wherein.

DESCRIPTION OF THE PREFERRED EMBODIMENT

Figures 1, 2, 3:
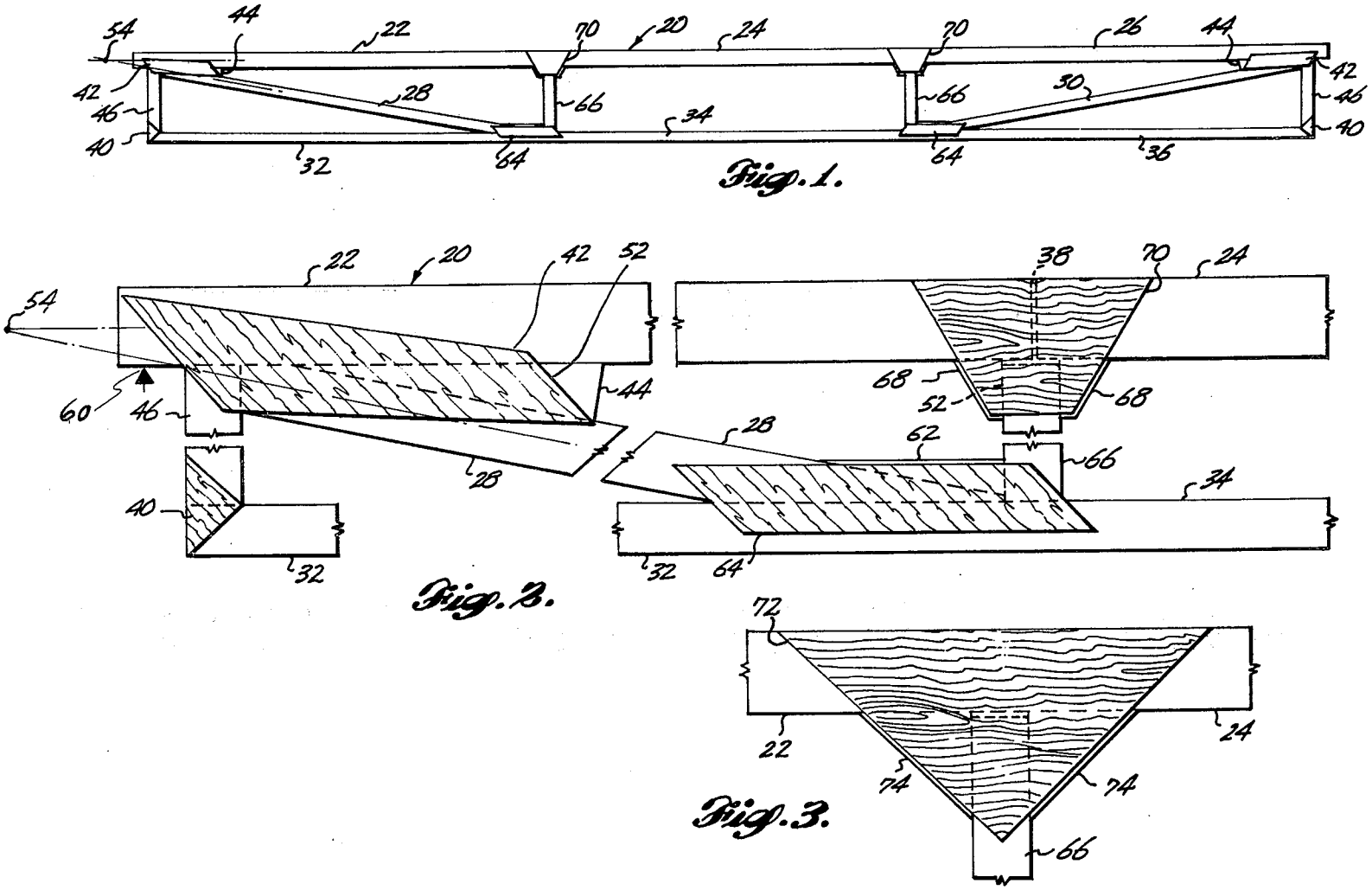
FIG. 1 is an elevational view of a selected all wood fabricated principal structure component designated as a rigid frame joist with an eccentric end configuration.
FIG. 2 is a partial enlarged view, with portions removed for illustrative purposes, showing in particular the overlaid plywood components at joints of whole wood components of the rigid frame joist shown in FIG. 1.
FIG. 3 is a partial elevational view of only one locale of overlaid plywood components at joints of whole wood components showing another positioning of the overlaid plywood, filler whole wood components, and filling grout than that shown in FIGS. 1 and 2.

In FIGS. 1, 2 and 3, a preferred embodiment of the product is shown. It is an all wood principal structural component 20, best referred to as a truss and shown in a configuration to be used as a roof and/or floor joist. All of its various composite pieces are secured together with glue. No fasteners are used.

In this embodiment and its method of manufacture, the eccentricity in the respective end joints is controlled to minimize bending stresses in all the main members. At each end reaction locale of the truss (1, FIG. 7), as the top and bottom chords approach one another, their center lines do not meet. This arrangement is predesigned to create a desired eccentricity which favorably controls, reduces and redistributes stresses in the wood. Specifically, the combination of heavy bending and high tension is the most adverse condition for stressing lumber, because knots, and other imperfections on the lower edge or face will cause intolerable stress concentrations to be created resulting in failure of the truss.

In the instant invention, it is designed eccentricity in the end joint which dramatically reduces the bending moment in the end diagonal and improves overall structural efficiency by 150%.

Moreover, plywood gusset plates are provided with their plies or laminations or veneers positioned on a bias. This not only enhances resistance to tearing and peeling but also permits the gusset together with an added post to absorb and transmit the bending which has been taken away from the end diagonal.

To indicate the efficient utilization of wood that is possible, a three panel truss 20 is illustrated in FIG. 1. Always top or load bearing chords 22, 24, 26 diagonal end members 28, 30 and lower chords 32, 34, 36 are of the same transverse thickness. These whole wood prime members are glued together and, only in compression joints, flowable and hardening filler is used as necessary. Then they are, in addition, connected together by gluing plywood supplemental members such as gusset plate 42 and/or haunch plates 70 located selectively at the whole wood joints. In some locations, smaller whole wood blocks serve as wood filler members. They are fitted and glued between converging whole wood members 22, 28 and adjacent the overlying plywood gusset plate 42 or haunch plates 70. All of these composite members of all wood principal structural components 20, such as the illustrated three panel truss 20, serve one or more load carrying functions and/or load distribution requirements to create a stronger overall product 20.

Commencing with an understanding of current research findings, based on structural whole wood and structural plywood tests, each of these composite members of an all wood structural component 20, has been sized and placed to create an overall beneficial distribution of an entire resultant loading that is expected to occur upon the installation of such component 20 in an overall structure, such as a factory and/or office building, not shown. In summary, these research results are: in comparison to other structural building materials, wood, in reference to its weight and cost, has a comparatively high tensile and compressive strength; the bending strength of wood is 25% to 33% greater than either its tensile or compressive strength; the tensile strength of wood in comparison to its compressive strength ranges down to about 80% of its direct compression strength; the ratio for wood is 1 to 16 with respect to its horizontal shear strength when compared to its bending strength; moreover, wood has nominal bearing strength transverse to its grain.

Therefore, these research results indicate how this all wood structural product 20 has been developed to selectively acquire the maximum utilization of bending strength of each respective composite member of these particular trusses, etc., positioned in their overall combined configuration, when such bending strength is known to be advantageous in reducing, tensile stresses, compressive stresses, and/or shear stresses. Moreover, this all wood structural product 20 has been developed by utilizing a glue only fastening method which is compatible with acquiring this maximum utilization of the bending strength while keeping both the shear stresses and bearing stresses at a reduced level.

Further, to acquire this new all wood structural product 20 of greater strength, while comparatively reducing the overall weight of the wood in each truss 20, etc., its joints have been made essentially rigid to thereby make the entire truss 20 essentially rigid. In so doing, each joint, as necessary is capable of fully developing the bending strength of the related transversely loaded members. Each truss of joist 20, has wide spaces between joints, i.e. wide panels. As illustrated in FIG. 1, truss or joist 20 has a three panel configuration with a rigid frame which comprises in effect a loop of chords and diagonals. Its to chord 22, 24, 26 is subjected to a compressive stress that is comparatively lower than chord stresses occurring in less rigid trusses of other designs.

The rigidity is obtained by not using penetrating, tearing and/or cutting fasteners, but instead by utilizing glue 52, with wood fillers 44, wood-like softened fillers 38 that harden, and overlying thin plywood pieces, that are specially shaped and grain oriented to become gussets 42 and haunches 70.

Glue line integrity is enhanced by using a glue 52 selected from one of several proven elastic adhesives. Preferably those which are moisture resistant are used, such as melamine formaldehyde and resorcinal formaldehyde. To the latter, a phenolic compound may be added for economy. These glues are easily cured during short heating periods under sufficient pressures so high production rates are possible. The utilization of the plywood overlays 42, does not unduly hinder the transfer of curing heat during press operations.

At all times the thinness of the plywood gussets 42 and haunches 70 is compatible with prime requirements of load distribution. Each plywood overlay 42, 70 especially the very long ones have sufficient reserve strength to avoid tearing while fully developing the maximum compression or tension in the adjoining whole wood composite members of a truss 20, etc. Moreover, the thinness of the plywood overlays 40, 42 insures the wanted development of shear strength across contacting faces of whole wood to plywood throughout their narrow overlapping portions.

The plywood gussets are shaped and positioned so their wood grain fibers are arranged at about 45° to the joint line between the whole wood members such as a top chord section 22 and diagonal end member 28 covered by gusset 42. Also, the gussets 42 have their important overall edge contour shapes. Additionally, plywood haunch plates 70 located along the top chord joints have a majority of their plies or laminations positioned parallel the compression forces and thus parallel to the direction of the top chord. These gussets 42 and haunches 70, although made of thin plywood, meet the overall specifications, for example, for a truss 20 designed for a sixty foot span to carry the roof load, yet the plywood material is made of plys totalling from ¼ to ⅜ inch in thickness.

All the intended designed spaces between the near joining compression butt ends of whole wood composite truss members are filled with a nonshrinkable high strength grout. Such a product is known by the trade name of "Por-rock" which is believed to be a starting mixture of portland cement and a filler, and at the time of use a catalyst is added. However, any non-shrinking grout that is water setting may be used.

As indicated previously the best strength properties of whole wood and plywood are utilized in these trusses 20. In this regard, to obtain the efficient utilization of the minimum wood and plywood composite truss members with corresponding reduction in factory produc tion times, bending stresses are uniquely redistributed as already shown and described in conjunction with the utilization of gussets 42 and haunches 70. Moreover, where a more beneficial distribution of all stresses, especially through redistribution of bending stresses, is needed to reduce the material and fabrication time costs, then bending stress resistance is enhanced at the places of support for respective truss ends. Such buildup of this resistance is undertaken by providing a very rigid end truss connection to a support, not shown, in an eccentric configuration as illustrated in FIGS. 1 and 2. The truss 20 is secured to such a support, wall or column, not shown, as top chord 22 rests on the support. In such position, a gusset 42 overlay is used with, preferably, a whole wood filler block 44 and these components are secrued by glue 52.

The effective eccentric configuration is further observed by noting in FIGS. 1 and 2, for example, that when the respective centerlines of top chord section 22 and diagonal end member 28 are imaginarily extended transversely, they meet at a point 54 which is beyond the reaction location of an eventual support, such as a wall or column, that is schematically symbolized by the support arrow 60. This illustrates how this reaction locale eccentricity at the time of the truss design may be calculated to the exact required bending design may be calculated so the exact required bending moment will be transmitted to the respective end of a top chord section 22 and beyond to the middle top chord section 24 through their rigid overall connection at haunch 70. By applying this bending moment into top chord 22, the bending moment in diagonal 28 is simultaneously reduced by an amount proportionate to its stiffness, relative to the stiffness of chord 22. Bending is thereby removed from diagonal 28, where it is undesirable, and placed into chord 22, where is it needed to reduce overall bending, transferred through rigid connection to chord 24.

Referring now to FIGS. 4–7 inclusive, the above discussed preplanned design eccentricity will be discussed in greater detail and effectively compared with prior art structures, more specifically a truss design according to the teachings of my prior U.S. Pat. No. 3,345,792 and shown in FIG. 6.

Figure 4:
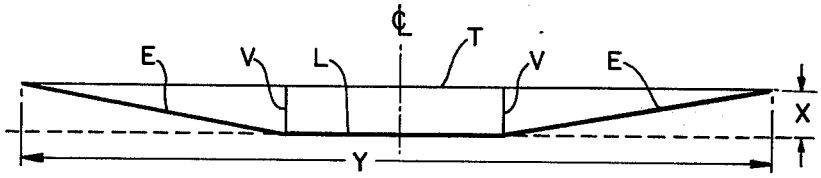
FIG. 4 is a schematic diagram of a 40 foot model span of optimum design.

In FIG. 4, the basic truss model for the specific joists disclosed here and in my prior above mentioned prior patent is illustrated. The model comprises a top chord centerline T, two end diagonal centerlines E, a lower chord centerline L, and two vertical struts V. Of course, the design is symmetrical about the centerline illustrated. In a specific instance, this is a design model for a truss having a span of 40 feet (distance Y) and a heighth of 30 inches, from a base line defined by lower chord centerline L, the dimension being illustrated by distance X.

A specific design and stress analysis was then undertaken involving the establishment of nodal points and the calculation of internal loading at these selected nodal points within the design structure. An all purpose computer is employed to calculate the required numbers. This is known as the EASE system, or Elastic Analysis for Structural Engineering.

Figure 5:
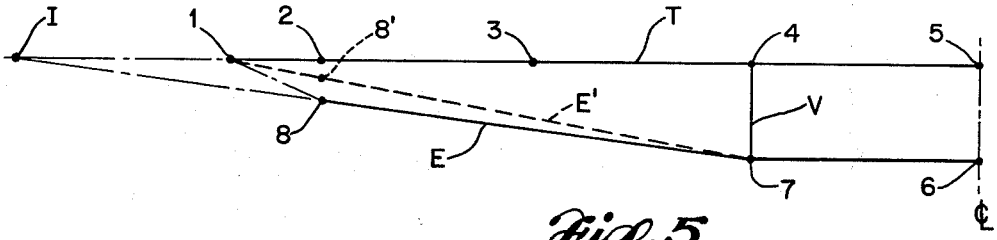
FIG. 5 is a schematic diagram of the left half of FIG. 4, drawn to an enlarged scale, and showing a concentric diagonal end member design, according to my prior U.S. Pat. No. 3,345,792, together with an eccentric design according to the present invention, each of which was subjected to sophisticated elastic analysis by computer.

FIG. 5 illustrates the left half of the design model with; end nodal point 1, 20 feet to the left of center; point 2, 17.5 feet to the left of center; point 3, 12 feet to the left of center; point 4, 6 feet to the left of center; point 5, top center; point 6, bottom center; point 7, below point 4 and points 8 and 8', below point 2.

Figure 6:
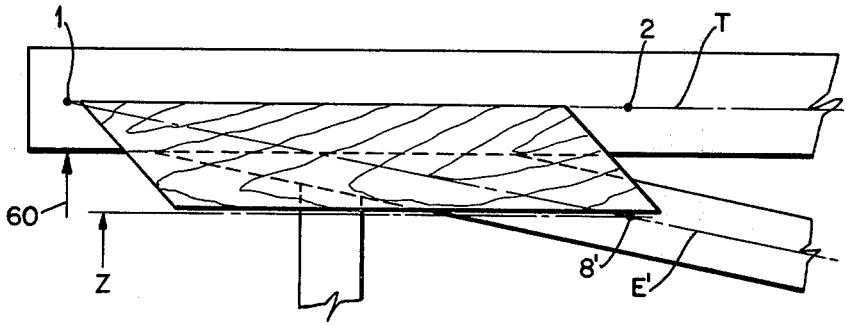
Fig. 6. PRIOR ART
FIG. 6 is an end detail of a truss according to my prior U.S. Pat. No. 3,345,792.
Figure 7:
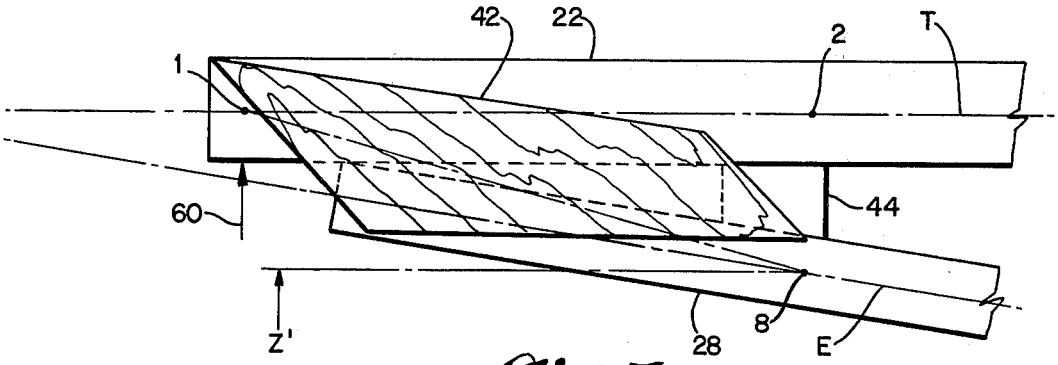
FIG. 7 is an end detail of a truss according to the instant invention.

Now, nodal points 1 through 7 are precisely the same, both in the prior art truss design (FIG. 6) and the design of this invention (FIG. 7). However, point 8 is changed from the standard, concentric design of FIG. 6, indicated by the model in FIG. 5 wherein end diagonal centerline E; indicated by dash lines, intercepts top chord centerline T and nodal point 1, directly above the eventual support (arrow 60), to the novel eccentric design of this invention, wherein end diagonal centerline E (solid line, FIG. 5), if extended, intercepts top chord centerline T well beyond and outside of the structural component or truss, or at point I, as shown in FIG. 5.

This change in disposition of nodal point 8 is illustrated in FIG. 6 (prior art) as being distance Z above the baseline established by lower chord L (FIG. 5), or 24.7 inches, and distance Z' from the baseline in FIG. 6 or 22.0 inches. It must be pointed out that the concentric design illustrated by FIG. 6 is virtually mandated by industry practice as well as sound structural engineering principles, "concentric", of course, meaning a designed, precise intersection of diagonal, top chord and reaction thrusts, with little or no eccentricity. This is most particularly true of wood trusses. However, this orthodox design led to an alarmingly high and seemingly unaccountable number of failures at relatively low stress levels in the case of my prior art design as illustrated in FIG. 6.

A prolonged period of research and testing revealed that the bending moment in end diagonal 28 at nodal point 8, again in the 40' span design being discussed, was in excess of 15,400 pound-inches, diagonal 28 being under about 9500 pounds tension.

However, in the case of the present invention including the factor of predetermined eccentric design as just discussed above taken together with the absorption and transmission of bending force from end diagonal 28 to top chord 22 via gusset plate 42 and post or filler 44, discussed infra, the bending moment at nodal point 8 was reduced to only 2115 pound-inches, with end diagonal under virtually the same tension, or about 9300 pounds.

The difference in performance between the two designs is rather significant. Simple stress design calculations result in a permissable unit load of only 3.3 pounds per inch, length along the top chord, in the prior art design of FIG. 6 as compared with 8.25 pounds per inch, length, in the design of the present invention. Thus, the effect of designed, predetermined end joint eccentricity is to improve the overall structural efficiency of the truss or joist by 150 percent in this specific case. In practice, this improvement factor has been found to be typical.

Such relocation, modification and/or redistribution of bending forces through such transmission of forces is undertaken when it is beneficial in modifying tensile and compressive forces at various locations throughout truss 20. A design and stress analysis followed by the manufacture of a truss 20 in accordance with this invention, reults in the production of a truss 20 which carries comparatively larger loads while requiring a smaller overall mass of wood.

In regard to the embodiment illustrated, the redistribution of bending forces is undertaken at each truss end at the joint of top chord section 22 or 26, and diagonal end member 28 or 30, by using a whole wood filler block 44 and a long plywood gusset 42 in a glued assembly. The upper, outer points of 42 are required to be extended to strengthen the end of top chord 22, which must resist entire load (i.e., end reaction), and also to resist peeling off gusset 42 caused by large rotational forces. The rigidity of these end joints is enhanced as the respective opposite ends of diagonal end members 28 or 30 are joined to central vertical strut or leg 66, and lower chord sections 32, 34 and/or 36 by employing whole wood filler blocks 62 and plywood gussets 64 with glue being evenly distributed throughout the joining surfaces.

At the joining of top chord section 24, at its respective ends, to respective chord sections 22 and 26 and to central vertical struts or legs 66, the joints are filled in part with a flowable hardening filler 38 which elastically compensates for contraction of whole wood composite members, thereby avoiding unwanted and unnecessary internal stresses. The filler 38 also forms a T, which bears against wood filler 68 and forms a larger section for bending resistance. Also, glue 52 is used throughout between the joining surfaces of either wood to wood or wood filler. Whole wood fillers 68 and a plywood central haunch 70 continue the redistribution of the bending loads.

For further enhancement of the overall rigidity of truss 20, gussets 42 are used where respective lower chord sections 32 and 36 join respective end leg or struts 46.

Whenever a plywood gusset is employed to play its role in maintaining rigidity and/or transferring, redistributing, and modifying bending forces, or in carrying other forces such as those which would otherwise cause tearing, the grain patterns are always arranged in a designated direction, as illustrated throughout the FIGS. 1, 2, and 3 with shading lines indicating such grain arrangements in the outer layer or ply or plywood. For example, gusset 42 has its outer plywood grain running on a 45° angle pattern.

However, as indicated, where bending and compression only are to be transferred, as through haunches 70 and 72, the outer plywood grain is always parallel to top chord sections 22, 24 and 26.

By comparing FIGS. 2 and 3, with respect to the joining of top chord sections 22, 24 26 to central vertical struts or legs 66, modifications of the plywood haunches 70, 72 with slight changes of whole wood fillers 68, 74 are possible within a range of specified bending stresses that are to be utilized beneficially to create a truss 20 of comparatively greater strength from an assembly of wood of the same or lower overall weight. T plug of grout 38 and haunch-shaped parallel plywood 70 is specifically required, unless bending is toogreat, and then a continuous member replaces chord portions 22, 24, 26.

The all wood principal structural component 20 in the illustrated embodiment or in its other embodiments, not shown, will only serve its designed load function if all of its components are, in every joint, sufficiently secured together. In this truss 20 glued together and not held by other fastening means, the contact of adjoined components through the glue must be thorough and strong. Lack of glue and/or too much glue must be avoided. Wherever glue is specified it must be there in the right quantity and be in thorough contact with adjoining components. This method of this invention insures that all the glued joints will be so constituted. Stated in another way, there will be adequate and uniform glue line contact throughout, which is often referred to as glueline integrity.

The method comprises the following steps to create a designed principal structural component 20 composed entirely of wood:

1. Cutting whole wood members from specified cross sectional shaped lumber having grain running longitudinally to serve as the principal members of a principal structural component such as a truss;
2. Cutting whole wood filler members;
3. Cutting plywood gusset and haunch members with grains running respectively on a bias parallel with respect to designated principal members being jointed;
4. Arranging all the components of whole wood and lower side plywood on a level layout support placing them in near contact with each other;
5. Coating all whole wood surfaces to be joined with glue such as phenol resorcinol formaldehyde at a temperature of from 40° to 90° F. ;
6. Filling butt voids in top chord with a nonshrinking filler such as "Por-rock" at a temperature of from 40° to 90° F.;
7. Arranging jig members to transversely hold all the components of whole wood in their level layout positions with glue lines in full contact;
8. Coating with glue such as phenol resorcinol formaldehyde at a temperature of from 40° to 90° F. all plywood to whole wood engaging surfaces at the component joints;
9. Placing the plywood over the top side of each joint of components, the bottom or lower side plywood having been placed on the level layout support below the whole wood components;
10. Compressing the whole wood and plywood together uniformly under a pressure in the range of 100 p.s.i. to 600 p.s.i., while maintaining the temperature in and about the joint between 150° and 400° F. for a period of 30 seconds to 30 minutes;
11. Removing the compression forces and the transverse holding forces freeing the completed principal structural component; and
12. Allowing the temperature to drop to the environmental temperature of 50° to 70° F.

These are steps, with some withdrawals and/or additions which are followed to create an all wood principal structural component such as truss 20, of comparatively greater strength than previously fabricated wood components yet using an assembly of wood of the same or lower overall weight.

SUMMARY OF ADVANTAGES

An all wood principal structural component 20 is available in many embodiments, each with all portions thereof glued together without any supplemental holding power being developed by any fasteners. Each component 20 carried comparatively greater loads than ever carried before by previously available trusses that involved reliance on metal fasteners either solely or in combination with glue. Moreover, gluing of filler blocks and plywood gussets and haunches at the respective joints strengthens these joints and also favorably modifies the bending stresses and other stresses in adjacent chords, diagonals, and/or struts of the open area trusses. The selected glues and their application under controlled temperatures and pressures hold all parts firmly together to receive and to transmit the overall design loadings. Throughout all the wood products, the pre-engineered reaction locale eccentricity is controlled in the end joints to minimize bending stresses in all the main members of the wood products such as joists and trusses. Moreover, the positioning of the plywood reinforcements in tension locales, often referred to as gusset plates, results in the wood grains of their plies, laminations or veneers, being positioned on a bias, which greatly enhances their tearing and peeling resistance. In addition, the plywood reinforcements in compression locales, often referred to as haunch plates, results in the wood grains of their majority of plies, laminations, or veneers, being positioned parallel to the direction of the chord members to reinforce the top chords at these locations of maximum bending stress.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. A structural component such as a truss or joist comprising multiple whole wood members, each with their grain arranged in the direction of its major dimension and as a group forming the outer periphery of said structural component having a top chord and spaced diagonal and vertical inner members, gusset members positioned over selected joints of some of the multiple whole wood members being joined together and said gussets being joined to the whole wood members solely by an adhesive, said diagonal members being secured to said top chord adjacent to the outer ends of said top chord the ends of the top chord having downwardly facing support surface areas for engagement by vertical support structure, said structural component having eccentric moments induced therein by having said support surfaces off-set entirely inwardly from the intersection of the center lines of said top chord and diagonal members in a precise, predetermined manner at least to significantly reduce bending stress in said diagonal members and further to distribute and minimize bending moments throughout the structural component.

2. The structural component according to claim 1 together with whole wood filler blocks glued between said top chord and said diagonal members in the region adjacent their juncture to assist in distributing and minimizing the bending moments.

3. The structural component according to claim 1 wherein whole wood members are spaced apart at selected joints and the space is filled with an initially fluid filler that subsequently becomes firm yet takes the shape of the irregular surfaces and avoids any build up of concentrated compressive stresses caused by direct whole wood to whole wood limited area contact.

4. A structural component such as a truss or joist comprising multiple whole wood members forming the outer periphery of said structural component having a top chord, spaced diagonal and vertical inner members and gusset members positioned over selected joints of some of the multiple whole wood members, at least including the joints between said diagonal members and said top chord members and in a manner to effectively absorb bending force from the diagonal members and transmit said bending force to said top chord, the ends of the top chord having downwardly facing support surface areas for engagement by vertical support structure, the centerlines of said top chord and diagonal members being eccentrically arranged in a predetermined fashion whereby imaginary intersections of said top chord and diagonal member centerlines lie completely outwardly of said structural component, beyond the end limits of said top chord.

* * * * *